US005357725A

United States Patent [19]

Ferry

[11] Patent Number: 5,357,725

[45] Date of Patent: Oct. 25, 1994

[54] UNIVERSAL TAP PLATE FOR MOUNTING EITHER HEAVY-WEIGHT OR LIGHT-WEIGHT HINGES

[75] Inventor: Raymond A. Ferry, McKenzie, Tenn.

[73] Assignee: Republic Builders Products, Inc., McKenzie, Tenn.

[21] Appl. No.: 121,281

[22] Filed: Sep. 14, 1993

[51] Int. Cl.[5] ..... E06B 1/04

[52] U.S. Cl. ..... 52/210; 52/100; 49/504; 16/222

[58] Field of Search ..... 52/210, 100; 49/504, 49/397, 381; 16/235, 236, 237, 238, 242, 243, 248, 222

[56] References Cited

U.S. PATENT DOCUMENTS 4,553,286 11/1985 Schwarz, II ..... 16/222 X

*Primary Examiner*—Carl D. Friedman
*Assistant Examiner*—Creighton Smith
*Attorney, Agent, or Firm*—Fay, Sharpe, Beall, Fagan, Minnich & McKee

[57] ABSTRACT

End portions (10) of a tap plate (A) are welded to a metal door frame (B) with welding projections (12). The tap plate (A) has a front face (18) which is recessed from a rabbet surface (22) of the door frame by a thickness (24) of a heavy-weight hinge leaf (26). Adjacent each of the tapped bores (30) for receiving a hinge leaf mounting bolt (32), a button (40) projects forward from the tap plate front face. The buttons project forward by a difference (54) between the thickness of the heavy-weight hinge leaf and a thickness (56) of a standard hinge leaf (58). Each of the buttons defines a necked-down portion (44) around its periphery. The projecting portion of the button is removed to mount a heavy-weight hinge leaf (FIG. 3). With the buttons still in place, a standard-weight hinge leaf is mounted to the tap plate with its front face flush with the rabbet surface of the door frame (FIG. 6).

12 Claims, 3 Drawing Sheets

UNIVERSAL TAP PLATE FOR MOUNTING EITHER HEAVY-WEIGHT OR LIGHT-WEIGHT HINGES

BACKGROUND OF THE INVENTION

The present invention relates to the door mounting arts. It finds particular application in conjunction with tap plates which are welded into metal door frames for receiving hinge leaves and will be described with particular reference thereto.

Rather than mounting hinges directly to metal door frames, metal door frames commonly have a cutout where hinges are to be installed. A tap plate is welded to the back of the frame to either side of and spanning the cutout. The tap plate has a central, recessed portion which is recessed from a rabbet surface of the metal door frame by the thickness of a hinge-leaf. The tap plate has threaded bores to receive threaded fasteners that extend through the mounted hinge leaf.

One drawback to these tap plates is that all hinges are not the same thickness. Heavy-weight hinges are thicker than standard hinges, for example. Thus, when heavy-weight hinges were to be used, the door frames had to be special ordered with a heavy-duty hinge tap plate.

In order to adapt the same tap plate for both standard and heavy-weight hinges, others proposed manufacturing the tap plate with insert plates. The insert plates were semi-permanently adhered such that the plates would remain in place for standard hinges. For heavy-weight hinges, the plates were removed in the field. One of the drawbacks of using plates or other inserts is the costs associated with the tooling for the extra part and the labor to install it.

The present invention provides a new and improved tap plate that is convertible for use with either standard and heavy-weight hinges.

SUMMARY OF THE INVENTION

In accordance with the present invention, a tap plate is provided which has a button projecting from a rabbet face thereof adjacent each of the threaded hinge mounting bores. Each button includes a flat central region and is surrounded by a necked-down region which connects the central region with the remainder of the tap plate. The necked-down region enables the projecting portion of the button to be removed with a hand grinder or chisel.

In accordance with one aspect of the present invention, a method of manufacturing and using a tap plate with either standard or heavy-weight hinges is provided. Buttons are extruded by pressure with an extrusion die on a rear face of the tap plate until flat buttons of a predetermined height form on a face surface of the tap plate. Bores are drilled next to the buttons and tapped to receive hinge mounting bolts. The tap plates are welded to a metal door frame. Standard hinges can be installed in the door frame with the tap plate as initially manufactured. For heavy-weight hinges, at least the portion of the button projecting from the face plate is removed, e.g. with a grinder or chisel. After removal of the buttons, a heavy-weight hinge is installed.

One advantage of the present invention is that it enables a single tap plate to be used with either standard or heavy-weight hinges.

Another advantage of the present invention is that tooling costs associated with extra pieces and the labor costs to install extra pieces are both eliminated.

Another advantage of the present invention is that it eliminates special orders for tap plates for heavy-weight hinges and/or reduces inventory.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
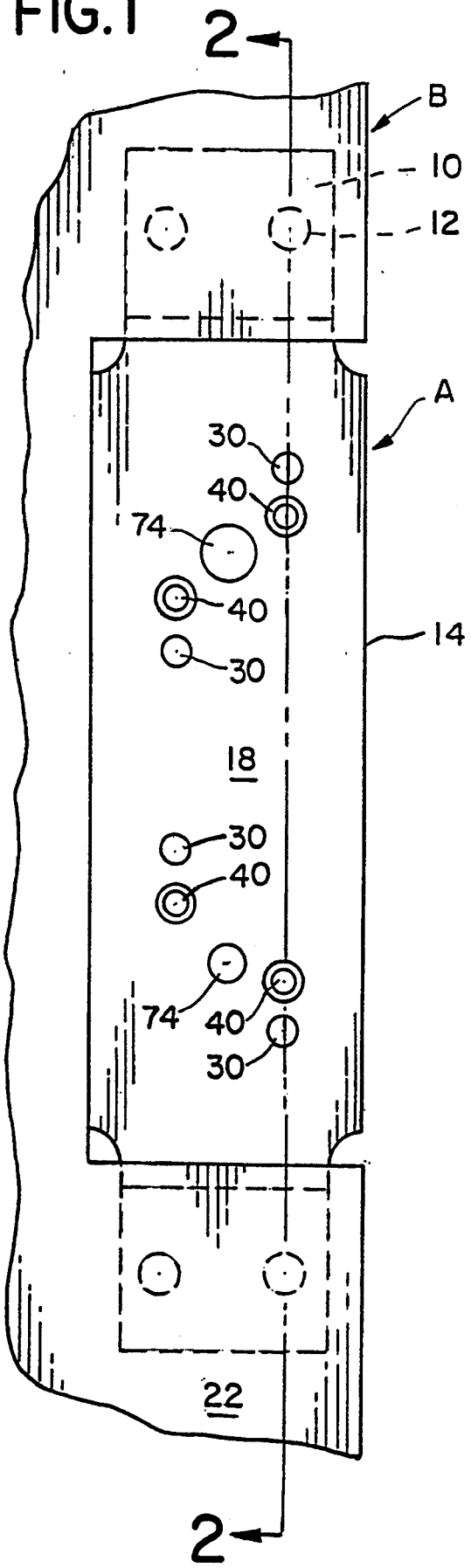
FIG. 1 is a front face view of a tap plate mounted in a portion of a steel door frame in accordance with the present invention.
Figure 2:
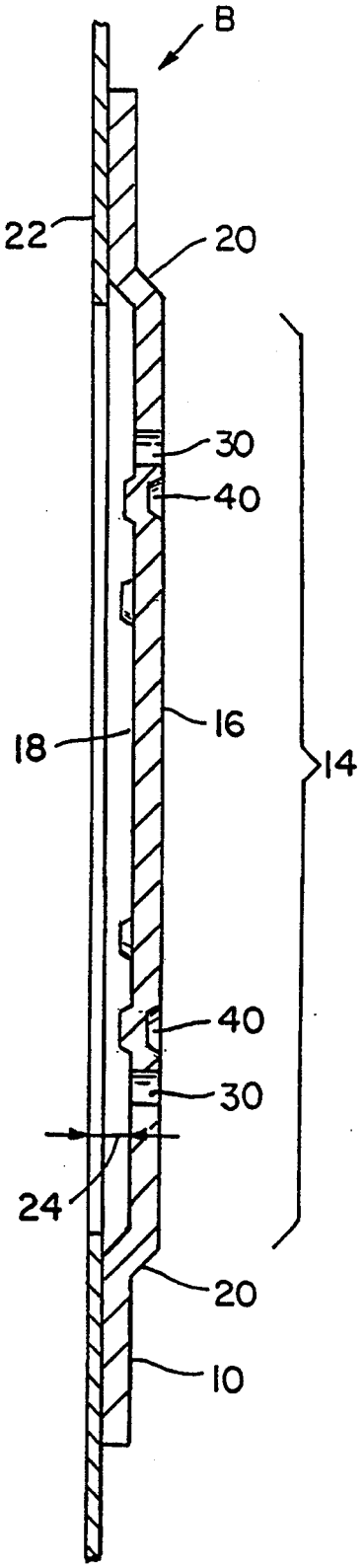
FIG. 2 is a vertical sectional view through section 2—2 of FIG. 1.
Figure 3:
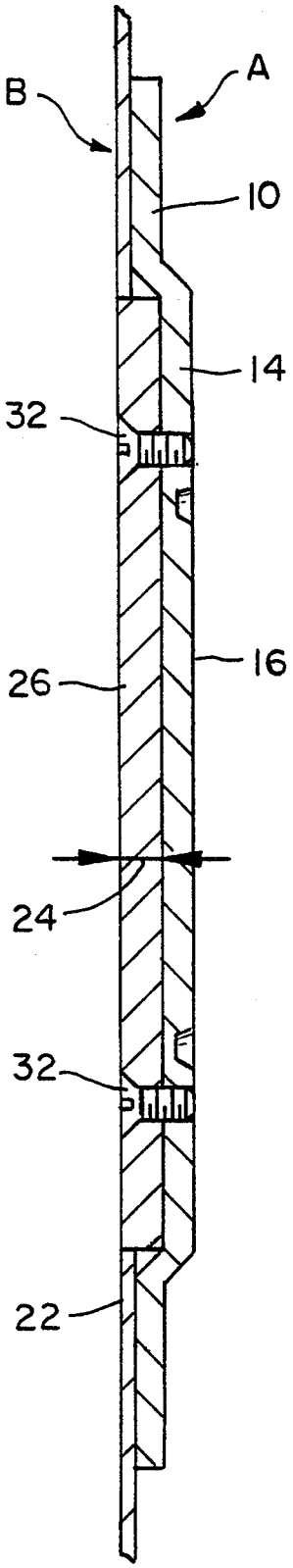
FIG. 3 is a side view of the tap plate and door frame portion of FIG. 1 in combination with a heavy-weight hinge leaf in section.

With reference to FIGS. 1 and 2, a tap plate A is mounted, preferably welded, to an inner surface of a metal door frame assembly B. The tap plate A includes end mounting portions 10 which include welding projections 12. The tap plate A includes a central hinge receiving portion 14 that includes a rear face 16 and a front or hinge abutting face 18. The tap plate includes jogs 20 such that the front face 22 of the central portion is recessed from a rabbet face 22 of the metal door frame by a preselected distance 24. More specifically, the front face 18 of the tap plate is recessed from the rabbet face 22 of the door frame by the thickness of a heavy-weight hinge leaf 26 (FIG. 3).

The central portion 14 includes four tapped or threaded bores 30 for receiving the mounting bolts 32 which secure either a standard or a heavy-weight hinge leaf to the tap plate A. The standard and heavy-weight hinge leaves have the mounting aperture pattern for receiving the mounting bolts enabling the same tapped bores in the tap plate to be used for both standard and heavy-weight hinges.

Figure 4:
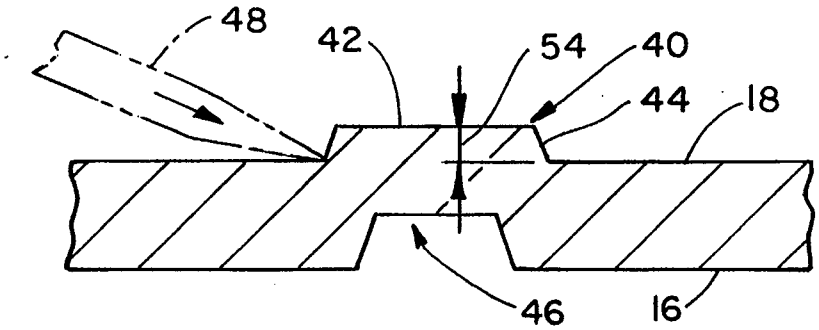
FIG. 4 is an enlarged, detailed cross sectional view of one of the buttons.

With continuing reference to FIGS. 1 and 2 and further reference to FIG. 4, a plurality of buttons 40 are defined projecting outward from the face of the tap plate. Each of the buttons includes a flat central portion 42 and a necked-down peripheral portion 44. The necked-down portion is extruded by pressure from a punch that forms a well 46 in the rear face 16. A chisel 48 is positioned at the necked-down portion or peripheral edge 44 and driven to cut off the projecting portion of the button 40. Analogously, the projecting portion of the button can be removed by a hand grinder or the like. ASTM366 or ASTM569 steel can be readily cut with a chisel.

Figure 5:
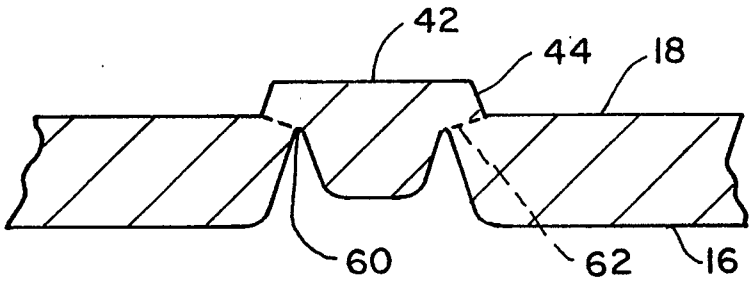
FIG. 5 is an alternate embodiment of a button in accordance with the present invention.

Optionally, with reference to FIG. 5, the punch which forms the rear well 46 may have a peripheral lip which forms a groove 50. The groove 50 reaches close to the plane of the front face 18 to define a narrow, peripheral fracture line 52. The button has sufficient material near the periphery that it is strong in compressive strength perpendicular to the front face, but fractures or shears readily in a plane generally parallel to the front face for easy removal of the button.

Figure 6:
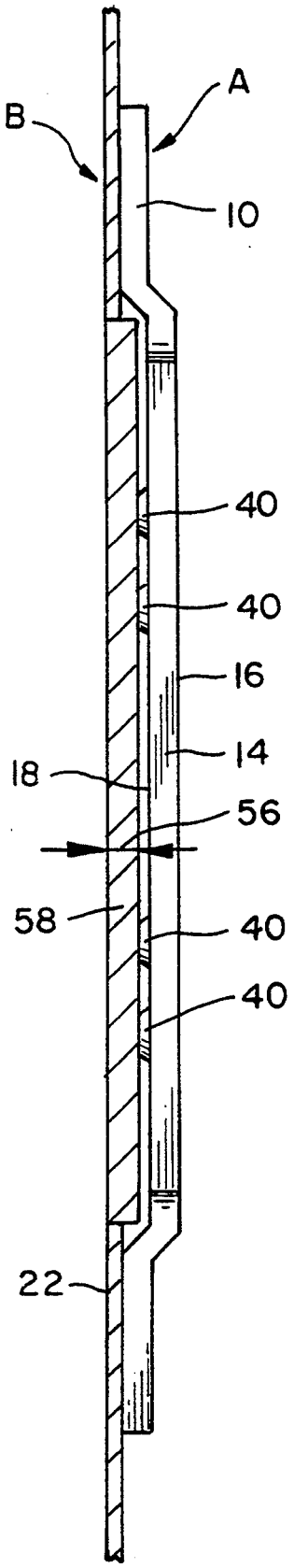
FIG. 6 is a side view of the tap plate and door frame portion of FIG. 1 in combination with a standard-weight hinge leaf in section; and, FIG. 7 illustrates a method of manufacturing the tap plate of the preceding FIGURES.

The flat central portion 42 of the button projects above the front face surface be by a height 54. Height 54 is the difference between the thickness 24 (FIG. 4) of the heavy-weight hinge leaf 26 (FIG. 3) and a thickness 56 of a standard-weight hinge 58 (FIG. 6). Stated another way, the central button portion 42 is displaced from the rabbet surface 22 of the steel frame by the thickness 56 of the standard hinge leaf 58.

In the preferred embodiment, there are four buttons, each disposed closely adjacent to one of the tapped bores 30. More specifically, the buttons are displaced from the tapped bores by less than the diameter of the tapped bore. Positioning the buttons closely adjacent the tapped bores inhibits bending or distortion of the hinge leaf under camming action of the mounting bolts 32. In the preferred embodiment, two of the buttons are located between the furthest spaced tapped bores to inhibit arcing of the hinge leaf toward its center and two of the buttons are disposed outward of the closer tapped bores to inhibit arcing of the hinge leaves adjacent their top and bottom extremes. Although there are four buttons in the preferred embodiment, it is to be appreciated that as few as three buttons in a triangle path may be provided. More than four buttons would be advantageous for improving the stability of the standard hinge mounting base.

Also in the preferred embodiment, the buttons are about $\frac{1}{4}$ inch in diameter. As the diameter of circular buttons increases, it becomes increasingly more difficult to sever the buttons. Buttons on the order of $\frac{1}{8}$–$\frac{1}{2}$ inch across are preferred. Preferably, each button is less than twice the diameter of the tapped bore. Although the buttons are illustrated as being circular in the preferred embodiment, it is to be appreciated that buttons of other shapes may also be utilized. For example, oval buttons, square buttons with rounded corners, rib-like buttons and the like may also be utilized.

Figure 7:
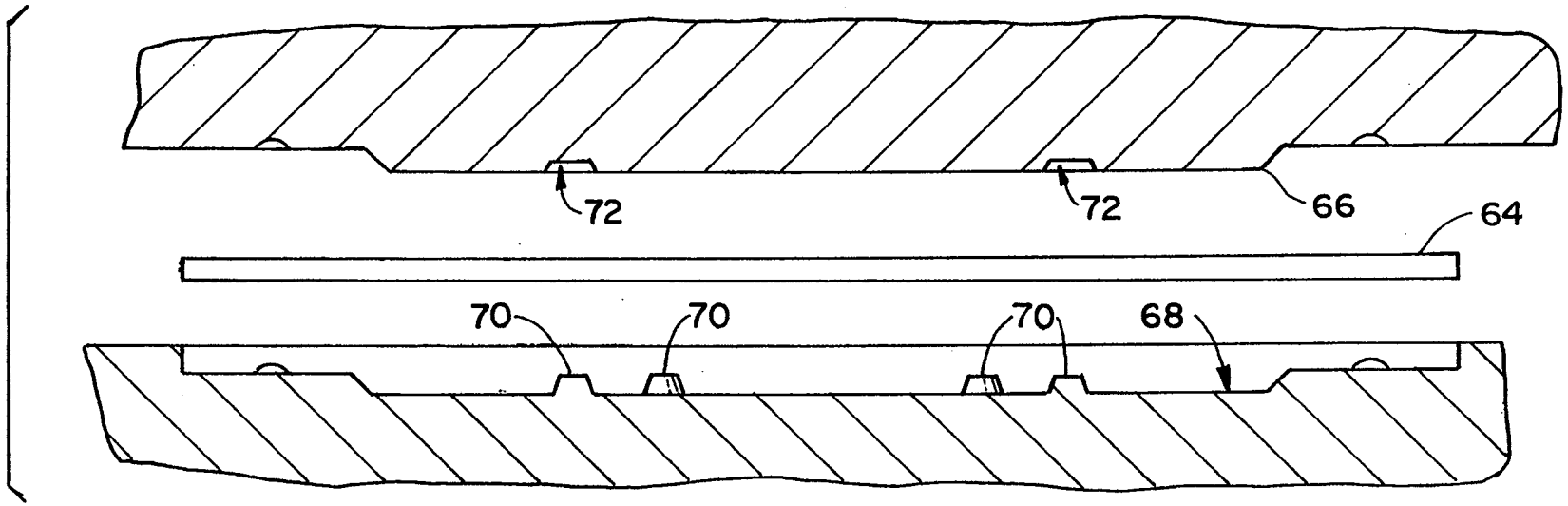

With reference to FIG. 7, the tap plates are made from a length of steel or other metal 60 which is pressed between dies 62, 64. The dies include mating projection 66 and recess 68 for offsetting the central portion 14 from the mounting portions 10. The dies further include a plurality of button-forming punches or projections 70 and mating defining wells 72 which interact to extrude the buttons 30. Optionally, the buttons may be defined in a second or later extruding or stamping process. The alignment apertures 74 for positioning the tap plate on a jig during the welding operation to ensure accurate alignment with the steel door frame in the central portion 14, and the four bores 30 are drilled in a drilling operation. The four bores 30 are tapped. Subsequently, the tap plates are welded at end portions 10 to the metal door frame B. The door frame is then painted or subject to other finishing operations.

With reference to FIG. 6, when one wishes to mount a standard-weight hinge, one positions the hinge leaf against the surface of the buttons, inserts the four mounting bolts, and tightens them down.

With reference to FIG. 4, when one wishes to install a heavy-weight hinge, one positions the chisels or grinds each of the buttons flat. With reference to FIG. 3, the heavy-weight hinge leaf is then mounted directly contacting the front face 18 of the tap plate and secure it in place by the mounting bolts 32.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A tap plate for selectively mounting standard and heavy-weight hinge leaves, the tap plate comprising:

mounting end portions for welding to a door frame assembly, which door frame assembly has a rabbet surface;

a central tap plate portion connected with the mounting end portions, the central tap plate portion having a substantially planar face which is recessed from the rabbet face surface by substantially a thickness of a heavy-weight hinge leaf;

a plurality of threaded bores through the central tap plate portion for receiving hinge leaf mounting bolts;

a plurality of severable buttons projecting upward from the central portion planar face by a height substantially equal to a difference between the heavy-weight hinge leaf thickness and a standard-weight hinge leaf thickness, the buttons being disposed adjacent the threaded bores.

2. The tap plate as set forth in claim 1 wherein the severable buttons have necked down portions, the necked-down portion having strong compressive strength in a direction perpendicular to the central portion planar face and being readily severable upon impact by a chisel at an acute angle.

3. The tap plate as set forth in claim 1 wherein there are four threaded bores and four severable buttons, two of the buttons being disposed between a pair of further spaced threaded bores and two of the buttons being disposed outward from a pair of closer spaced threaded bores.

4. The tap plate as set forth in claim 1 wherein each of the buttons is smaller than $\frac{1}{2}$ inch along a major dimension.

5. The tap plate as set forth in claim 1 wherein each of the buttons is displaced from a most closely adjacent threaded bore by a distance less than a diameter of the threaded bore.

6. The tap plate as set forth in claim 4 wherein the button has a major diameter which is less than twice the threaded bore diameter.

7. A door frame assembly including a metal door frame having cutout portions for receiving hinges and a tap plates mounted in each of the cutout regions, the tap plate comprising:

mounting end portions for welding to a door frame assembly, which door frame assembly has a rabbet surface;

a central tap plate portion connected with the mounting end portions, the central tap plate portion having a substantially planar face which is recessed from the rabbet surface by substantially a thickness of a heavy-weight hinge leaf;

a plurality of threaded bores through the central tap plate portion for receiving hinge leaf mounting bolts;

a plurality of severable buttons projecting upward from the central portion planar face by a height substantially equal to a difference between the heavy-weight hinge leaf thickness and a standard-weight hinge leaf thickness.

8. The door frame assembly as set forth in claim 7 wherein the severable buttons have necked down portions, the necked-down portion having strong compressive strength in a direction perpendicular to the central portion planar face and being readily severable upon impact by a chisel at an acute angle.

9. The door frame assembly as set forth in claim 7 wherein there are four threaded bores and four severable buttons, each of the buttons being disposed closely adjacent to one of the threaded bores.

10. The door frame assembly as set forth in claim 7 wherein each of the buttons is smaller than $\frac{1}{2}$ inch along a major dimension.

11. The door frame assembly as set forth in claim 7 wherein each of the buttons is displaced from a most closely adjacent threaded bore by a distance less than a diameter of the threaded bore.

12. The door frame assembly as set forth in claim 7 wherein the button has a major diameter which is less than twice the threaded bore diameter.

* * * * *